US009211232B2

(12) United States Patent
Bae et al.

(10) Patent No.: US 9,211,232 B2
(45) Date of Patent: Dec. 15, 2015

(54) CARTRIDGE FOR MEDICATION DISPENSING APPARATUS HAVING AUTO LOCKING FUNCTION

(71) Applicant: Infopia Co., Ltd, Anyang-si (KR)

(72) Inventors: Byeong-Woo Bae, Anyang-si (KR); Keun-Young Kim, Seoul (KR)

(73) Assignee: Infopia Co., Ltd., Anyang-si (KR)

( * ) Notice: Subject to any disclaimer, the term of this patent is extended or adjusted under 35 U.S.C. 154(b) by 178 days.

(21) Appl. No.: 13/948,647

(22) Filed: Jul. 23, 2013

(65) Prior Publication Data

US 2014/0203034 A1 Jul. 24, 2014

(30) Foreign Application Priority Data

Jan. 23, 2013 (KR) ..... 10-2013-0007609

(51) Int. Cl.
*G07F 17/00* (2006.01)
*A61J 7/00* (2006.01)
*G07F 11/44* (2006.01)

(52) U.S. Cl.
CPC ..... *A61J 7/0076* (2013.01); *A61J 7/0084* (2013.01); *G07F 11/44* (2013.01); *G07F 17/0092* (2013.01)

(58) Field of Classification Search
None
See application file for complete search history.

(56) References Cited

U.S. PATENT DOCUMENTS 4,903,861 A * 2/1990 Yuyama ..... 221/265
6,073,799 A 6/2000 Yuyama et al.
6,394,308 B1 * 5/2002 Yuyama et al. ..... 221/265
6,901,229 B2 * 5/2005 Nishiuwatoko et al. ..... 399/167
7,040,505 B2 * 5/2006 Hashimoto et al. ..... 221/203
7,131,554 B2 11/2006 Hashimoto
7,395,946 B2 * 7/2008 Yuyama et al. ..... 221/265
7,562,791 B2 * 7/2009 Yuyama et al. ..... 221/265
7,857,162 B2 * 12/2010 Minami et al. ..... 221/82
2005/0230413 A1 * 10/2005 Kim ..... 221/265
2007/0157551 A1 * 7/2007 Yuyama et al. ..... 53/281
2009/0301603 A1 * 12/2009 Yuyama ..... 141/234
2010/0287880 A1 * 11/2010 Yasunaga et al. ..... 53/64
2012/0024882 A1 * 2/2012 Houghton et al. ..... 221/1

(Continued)

FOREIGN PATENT DOCUMENTS

CN 1543415 A 11/2004
EP 1 428 756 A1 6/2004

(Continued)

OTHER PUBLICATIONS

European Search Report mailed Dec. 18, 2014 in counterpart European Application No. 13176099.3 (3 pages, in English).

*Primary Examiner* — Gene Crawford
*Assistant Examiner* — Ayodeji Ojofeitimi
(74) *Attorney, Agent, or Firm* — NSIP Law

(57) ABSTRACT

There is provided a cartridge for a medication dispensing apparatus having an auto locking function, the cartridge including a cartridge case; a drum; a cartridge base; and a driving means, wherein a hollow cylinder having a coupling groove drilled therein is formed at a center of a bottom of the drum, a lifting body having an elastic protrusion elastically coupled to the coupling groove is inserted into the cylinder, wherein, when a rotation shaft of the driving means is inserted into the cylinder, the lifting body moves upward and then the elastic protrusion is separated from the coupling groove, whereas, when the rotation shaft of the driving means is separated from the cylinder, the lifting body moves downward and then the elastic protrusion is coupled to the coupling groove.

6 Claims, 4 Drawing Sheets

(56) References Cited

U.S. PATENT DOCUMENTS

| | | | |
|---|---|---|---|
| 2012/0239186 | A1 | 9/2012 | Kim |
| 2013/0233894 | A1 | 9/2013 | Kim |
| 2013/0240555 | A1 | 9/2013 | Kim |

FOREIGN PATENT DOCUMENTS

| | | | | |
|---|---|---|---|---|
| EP | 1604631 | A1 * | 12/2005 | ..... A61J 7/00 |
| JP | 9-323702 | A | 12/1997 | |
| JP | 10-314277 | A | 12/1998 | |
| JP | 2000-043801 | A | 2/2000 | |
| JP | 2000-203502 | A | 7/2000 | |
| JP | 4249015 | B2 | 4/2009 | |
| KR | 10-2012-0040539 | A | 4/2012 | |
| KR | 10-1147540 | B1 | 5/2012 | |
| KR | 10-2012-0057436 | A | 6/2012 | |
| KR | 10-2012-0105265 | A | 9/2012 | |

* cited by examiner

CARTRIDGE FOR MEDICATION DISPENSING APPARATUS HAVING AUTO LOCKING FUNCTION

CROSS-REFERENCE TO RELATED APPLICATION

This application claims the benefit under 35 U.S.C. §119 (a) of Korean Patent Application No. 10-2013-0007609, filed on Jan. 23, 2013, in the Korean Intellectual Property Office, the entire disclosure of which is incorporated herein by reference for all purposes.

BACKGROUND

1. Field

The following description relates to a cartridge for a medication dispensing apparatus, the cartridge is able to control rotation of the drum which open and/or close an outlet of the cartridge case.

2. Description of the Related Art

In order to solve drawbacks of a pharmacist manually dispensing medication, a medication dispensing apparatus is needed. If a doctor orders medication for a prescription using a computer, the medication dispensing apparatus automatically divides medication into dose per serving. Such a medication dispensing apparatus includes a medication cabinet for keeping medication separate according to types, and a packing unit which is disposed below the medication cabinet and packs medication supplied from the medication cabinet.

The medication cabinet is configured to include a plurality of medication cartridges. A medication cartridge contains the same type medication, and dispenses the medication to the packing unit in accordance with a prescription signal. A case of the medication cartridge includes a cartridge case having an outlet on the bottom thereof so as to dispense medication; a drum installed inside of the cartridge case so as to selectively open and/or close the outlet; a cartridge base having the cartridge case installed thereon; and a driving means connected to the drum to thereby rotate the drum.

However, when the cartridge case is detached from the cartridge base, the drum is often rotated arbitrarily, so that remaining medications may leak and foreign materials may enter into the cartridge.

SUMMARY

The following description aims to provide a cartridge case for a medication dispensing apparatus, the cartridge case which includes a locking means to automatically close an outlet of a cartridge case when the cartridge case is moved or is supplied with medication.

In one general aspect, there is provided a cartridge for a medication dispensing apparatus having an auto locking function, the cartridge including a cartridge case having an open outlet on the bottom thereof so as to dispense medication; a drum installed inside of the cartridge case so as to selectively open and/or close the outlet; a cartridge base having the cartridge case installed thereto; and a driving means connected to the drum and configured to drive the drum to be rotated, wherein a hollow cylinder having a coupling groove drilled therein is formed at a center of a bottom of the drum, a lifting body having an elastic protrusion elastically coupled to the coupling groove is inserted into the cylinder, wherein, when a rotation shaft of the driving means is inserted into the cylinder, the lifting body moves upward and then the elastic protrusion is separated from the coupling groove, whereas, when the rotation shaft of the driving means is separated from the cylinder, the lifting body moves downward and then the elastic protrusion is coupled to the coupling groove.

The lifting body may include a flat top surface, a flat bottom surface, a vertical frame configured to connect the top surface and the bottom surface, and an elasticity supporter extended from the top surface downwardly and having the elastic protrusion protruding to outside.

The elastic protrusion may have a slope in a contacting portion in which the elastic protrusion is in contact with the coupling groove, so that the elastic protrusion is able to be smoothly coupled to and separated from the coupling groove.

A plurality of elastic supporters may be formed around the vertical frame, disposed at a center of the lifting body, in a radial manner, and a plurality of coupling grooves may be formed in the cylinder in a radial manner.

A compressed spring configured to push the lifting body may be disposed between the cylinder and the lifting body.

The protrusions to which the compression spring is fitted may be formed inside an upper part of the cylinder and outside an upper part of the lifting body.

Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

Figure 1:
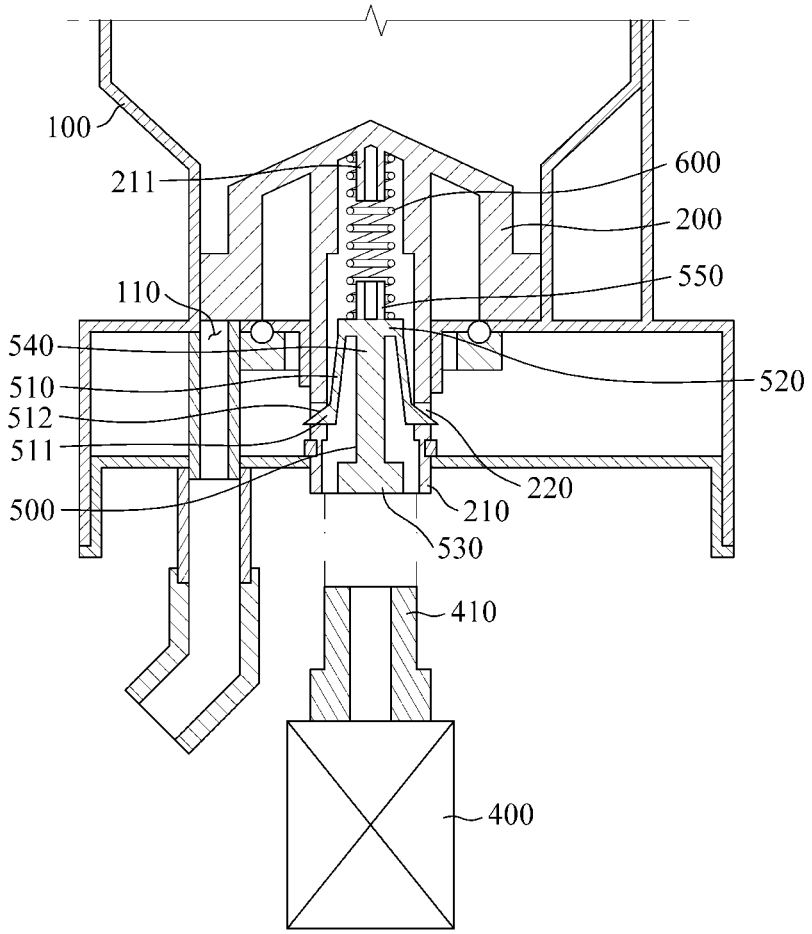
FIG. 1 is a cross sectional view illustrating a locked cartridge having an auto locking function for a medication dispensing apparatus according to an exemplary embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will suggest themselves to those of ordinary skill in the art. Also, descriptions of well-known functions and constructions may be omitted for increased clarity and conciseness.

Figure 2:
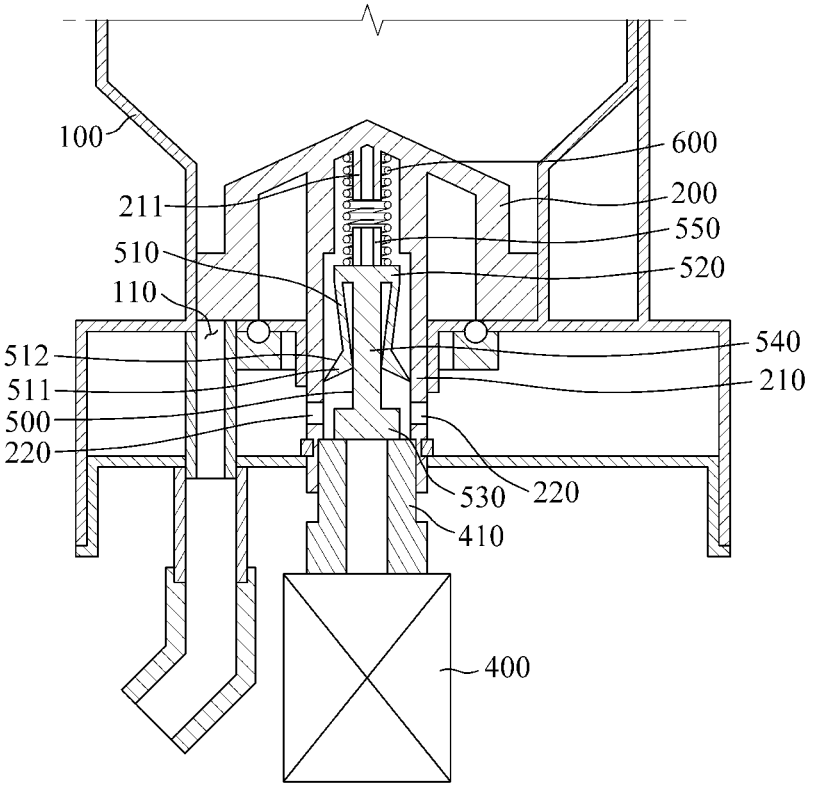
FIG. 2 is a cross sectional view illustrating an unlocked cartridge having an auto locking function for a medication dispensing apparatus according to an exemplary embodiment of the present invention.

FIG. 1 is a cross sectional view illustrating a locked cartridge for a medication dispensing apparatus having an auto locking function, and FIG. 2 is a cross sectional view illustrating an unlocked cartridge for a medication dispensing apparatus having an auto locking function.

According to an exemplary embodiment of the present invention, a cartridge for a medication dispensing apparatus having an auto locking function includes a cartridge case 100 having an open outlet 110 formed on the bottom thereof to dispense medication, a drum 200 installed inside of the cartridge case 100 to selectively open and/or close the outlet 110, a cartridge base (not shown) including the cartridge case 100 installed thereto, and a driving means 400 connected to the drum 200 to be rotated. At this point, at the center of the bottom of the drum 200, a hollow cylinder 210 is formed in an extended manner and has coupling grooves 220. In the cylinder 210, a lifting body 500 is fitted, and the lifting body 500 has elastic protrusions 510 to be engaged with the coupling grooves 220. In the event that a rotation shaft 410 of the driving means 400 is inserted into the cylinder 210, if the lifting body 500 moves upward, the elastic protrusions 511 are separated from the coupling grooves 220. In the event that the rotation shaft 410 of the driving means 400 is separated from the cylinder 210, if the lifting body 500 moves downward, the elastic protrusions 511 are coupled to the coupling grooves 220.

The cartridge case 100 is configured to have an inner space and include an open top. Accordingly, medication may be contained in the inner space of the cartridge case 100 by being supplied through the top. The medication may be various types of medications, such as a tablet and powders. On the bottom of the cartridge case 100, an outlet 110 is formed to dispense the medication.

The drum 200 is installed inside of the cartridge case 100 so as to selectively open and/or close the outlet 110. That is, the drum 200 is connected to the driving means 400 fixed to a cartridge base (not shown) to which the cartridge case 100 is installed, and is rotated in accordance with a prescription signal to open and/or close the outlet 110. The drum 200 and the driving means 400 are connected to each other through the cylinder 210 which is formed on the bottom of the drum 200 in an extended manner. In more detail, at the event when the rotation shaft 410 is inserted into the cylinder 210, if the driving means 400 is rotated, the drum 200 may be rotated. The driving means 400 may be controlled by a control unit which controls overall operations of the apparatus for drug packing.

The cylinder 210 is in the form of a hollow tube which is extended from the mid-lower part of the drum 200 to the lower part thereof, and has the coupling grooves 220 formed thereon. Each of the coupling grooves 220 may be configured to have a long vertical length, allowing the elastic protrusion 511 to be coupled thereto. The lifting body 500 moves upward and downward while being accommodated inside of the cylinder 210. The lifting body 500 has the elastic protrusions 511 formed thereon. Each of the elastic protrusions 511 is able to become widened and closed elastically to thereby be coupled to the coupling groove 220.

Accordingly, if the rotation shaft 410 is inserted into the cylinder 210, the rotation shaft 410 may press the lifting body 500 to thereby be moved upward, the elastic protrusions 511 may be separated from the coupling grooves 220, respectively, to thereby release the locked cylinder 210, and, in turn, the drum 200 may be rotated. Alternatively, if the rotation shaft 410 is separated from the cylinder 210, the lifting body 500 may move downward, the elastic protrusions 511 may be coupled to the coupling grooves 220, respectively, to thereby render the cylinder 210 locked, and, in turn, the drum 200 may be unable to be rotated. At this point, for a more complete prevention of the drum 200 from being rotated, an end of each elastic protrusion 511 may protrude to the outside of the coupling groove 220.

According to an exemplary embodiment of the present invention, the lifting body 500 includes a flat top surface 520, a flat bottom surface 530, a vertical frame 540 connecting the top surface 520 and the bottom surface 530, and an elasticity supporter 510 which is extended from the top surface 520 toward the bottom of the lifting body 500 and has the elastic protrusion 510 protruding to the outside of the elasticity supporter 510. The elasticity supporter 510 may be extended from one side of the upper side 520 toward the bottom of the lifting body 500 to be perpendicular to the top surface 520 or to be tilted toward the outside. In the above example, the lifting body 500 including the elasticity supporter 510 needs to be composed of various elastic materials including synthetic resin, and the elasticity supporter 510 may become closed or widened due to its own elasticity. Accordingly, the elastic protrusion 511 protruding to the outside of the elasticity supporter 510 may bounce between being coupled to and separated from the coupling groove 220 due to elasticity of the elasticity supporter 510.

Figure 3:
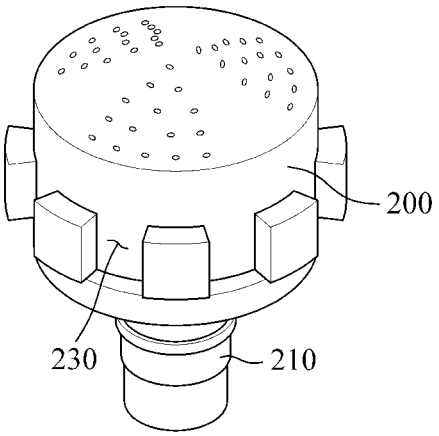
FIG. 3 is an exploded view of a drum shown in FIG. 1.
Figure 4:
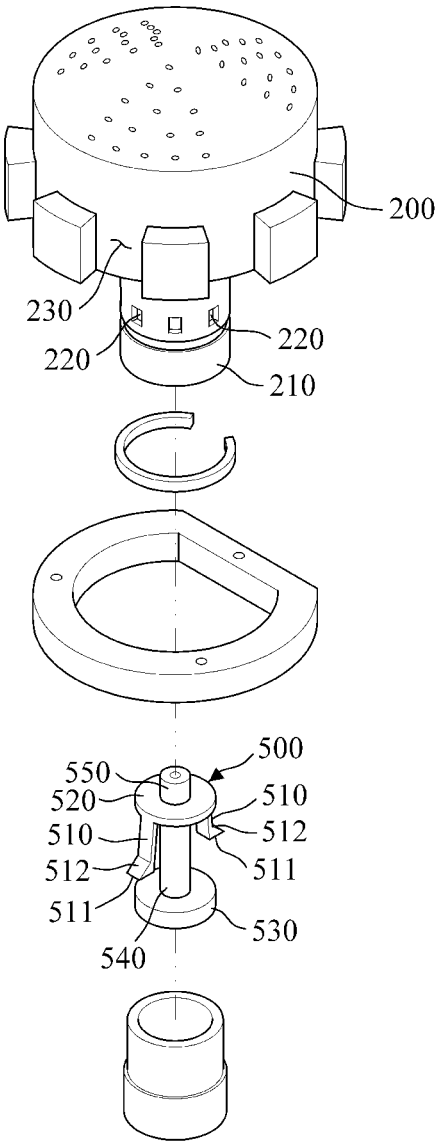
FIG. 4 is an exploded view of a drum and a lifting body, both shown in FIG. 1.

FIG. 3 is a perspective view illustrating a drum shown in FIG. 1, and FIG. 4 is an exploded perspective view illustrating a drum and a lifting body, both shown in FIG. 1.

According to an exemplary embodiment of the present invention, the elastic protrusion 511 has a slope 512 so that the elastic protrusion 511 is able to be smoothly coupled to and separated from the coupling groove 220. That is, the elastic protrusion 511 may have a semicircle or triangle cross section to thereby be easily coupled to or separated from the coupling groove 220. In particular, a contacting portion of the elastic protrusion 511, which is in contact with the coupling groove 220, may have a slope 512 which is tilted downward in a straight or curved manner. With the slope 512 formed as described above, the elastic protrusion 511 may be smoothly coupled to or separated from the coupling groove 220 along the slope 512, so that the lifting body 500 may be able to move upward or downward more smoothly.

In the above example, two or more elasticity supporter 510 may be formed around a vertical frame 540, disposed at the center of the lifting body 500, in a radial manner. In addition, the coupling grooves 220, whose number is as many as or greater than that of cells 230 formed on an outward wall of the drum 200, are formed on the cylinder 210 in a radial manner. In more detail, the coupling grooves 220, whose number is greater than twice the number of the cells 230, may be formed on the cylinder 210 in a radial manner. If a plurality of elastic protrusions 511 are formed as described above, a plurality of elastic protrusions 511 are coupled to a plurality of coupling grooves 220, respectively, thereby fixing the cylinder 210 to the lifting body 500 more tightly and thus preventing the drum 200 from being rotated arbitrarily. In this regard, if a plurality of coupling grooves 220 are formed as described above, the elastic protrusions 511 may be coupled to the coupling grooves 220 in a fitted way, thereby more completely preventing the drum 200 from being rotated arbitrarily.

In the above example, between the cylinder 210 and the lifting body 500, there is a compressed spring 600 configured to push the lifting body 500. That is, in response to the rotation shaft 410 being inserted into the cylinder 210, the rotation shaft 410 presses the lifting body 500, the compressed spring 600 is pressed, the lifting body 500 moves upward, and, in turn, a locked state of the cylinder 210 is released. Alternatively, in response to the rotation shaft 410 being separated from the cylinder 210, the rotation shaft 410 no longer presses the lifting body 500, the lifting body 500 moves downward due to elasticity of the compressed spring 600, and, in turn, the unlock cylinder 210 becomes locked. In this case, tension of the compressed spring 600 may be set within a wide range in which it is assured that the elastic protrusion 511 does not become separated from the coupling groove 220.

A modulus of elasticity of the compressed spring 600 may be represented by tensile stress and tensile strain, as shown in Equation 1.

$$E = \frac{\sigma}{\varepsilon} = \frac{F/A_0}{\Delta l/l_0} = \frac{Fl_0}{A_0 \Delta l} \quad \text{[Equation 1]}$$

In addition, a modulus of elasticity of the compressed spring 600 needs to be greater than a frictional force $F_s$ between the lifting body 500 and the cylinder 210 but less than a pushing force $F_m$ of the raft shaft 410, as shown in Equation 2.

$$E = \begin{cases} E < F_m \\ E > F_s \end{cases} \quad \text{[Equation 2]}$$

In the above embodiment, fixed protrusions 211 and 550, to which the compressed spring 600 is fitted, are formed inside an upper part of the cylinder 210 and outside an upper part of the lifting body 500. Using the fixed protrusions 211 and 550, the compressed spring 600 may be securely fixed to the cylinder 210 and the lifting body 500. Accordingly, the compressed spring 600 may be expanded and contracted more precisely, and thus may push the lifting body 500 in a vertical direction more accurately, so that the elastic protrusion 511 may be coupled to the coupling groove 220 in a fitted way.

In the above described embodiment, in the event that a user moves the cartridge case 100 or supplement medication of the cartridge case 100, if the rotation shaft 410 of the driving means 400 is detached from the cylinder 210 of the drum 200 inserted into the cartridge case 100, it is possible to control the drum 200 not to be rotated arbitrarily. Accordingly, any follow-up operation is not necessary to close the outlet 110 of the cartridge case 100. Instead, the outlet 110 of the cartridge case 100 is automatically closed, thereby preventing medication waste and protecting the medication. Alternatively, in the event that the rotation shaft 410 of the driving means 400 is inserted into the cylinder 210 of the drum 200 which is inserted into the cartridge case 100 installed on a cartridge base, a locked state of the drum 200 is automatically released and thus the drum 200 may be able to be rotated, so that the outlet 110 may be open without any operation.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A cartridge for a medication dispensing apparatus having an auto locking function, the cartridge comprising:

a cartridge case having an open outlet on the bottom thereof so as to dispense medication;

a drum installed inside of the cartridge case so as to selectively open and/or close the outlet;

a cartridge base having the cartridge case installed thereto; and a driving means connected to the drum and configured to drive the drum to be rotated, wherein a hollow cylinder having a coupling groove drilled therein is formed at a center of a bottom of the drum, a lifting body having an elastic protrusion elastically coupled to the coupling groove is inserted into the cylinder, wherein, when a rotation shaft of the driving means is inserted into the cylinder, the lifting body moves upward and then the elastic protrusion is separated from the coupling groove, whereas, when the rotation shaft of the driving means is separated from the cylinder, the lifting body moves downward and then the elastic protrusion is coupled to the coupling groove.

2. The cartridge of claim 1, wherein the lifting body comprises a flat top surface, a flat bottom surface, a vertical frame configured to connect the top surface and the bottom surface, and an elasticity supporter extended from the top surface downwardly and having the elastic protrusion protruding to outside.

3. The cartridge of claim 2, wherein the elastic protrusion has a slope in a contacting portion in which the elastic protrusion is in contact with the coupling groove, so that the elastic protrusion is able to be smoothly coupled to and separated from the coupling groove.

4. The cartridge of claim 2, wherein a plurality of elastic supporters are formed around the vertical frame, disposed at a center of the lifting body, in a radial manner, and a plurality of coupling grooves are formed in the cylinder in a radial manner.

5. The cartridge of claim 1, wherein a compressed spring configured to push the lifting body is disposed between the cylinder and the lifting body.

6. The cartridge of claim 5, wherein fixing protrusions to which the compression spring is fitted is formed inside an upper part of the cylinder and outside an upper part of the lifting body.

* * * * *